US009931755B2

(12) United States Patent
Gilor

(10) Patent No.: US 9,931,755 B2
(45) Date of Patent: Apr. 3, 2018

(54) SAFETY RAZOR

(71) Applicant: Avraham Gilor, San Diego, CA (US)

(72) Inventor: Avraham Gilor, San Diego, CA (US)

( * ) Notice: Subject to any disclaimer, the term of this patent is extended or adjusted under 35 U.S.C. 154(b) by 0 days.

(21) Appl. No.: 15/808,726

(22) Filed: Nov. 9, 2017

(65) Prior Publication Data

US 2018/0065264 A1 Mar. 8, 2018

Related U.S. Application Data

(63) Continuation-in-part of application No. 15/081,386, filed on Mar. 25, 2016, now Pat. No. 9,840,014.

(30) Foreign Application Priority Data

Sep. 5, 2017 (EP) ..... 17001490

(51) Int. Cl.
*B26B 21/44* (2006.01)
*B26B 21/18* (2006.01)
*B26B 21/40* (2006.01)

(52) U.S. Cl.
CPC ..... *B26B 21/443* (2013.01); *B26B 21/18* (2013.01); *B26B 21/4018* (2013.01); *B26B 21/4025* (2013.01)

(58) Field of Classification Search
CPC ... B26B 21/18; B26B 21/443; B26B 21/4018; B26B 21/4025
USPC ..... 30/41, 41.5, 51–54
See application file for complete search history.

(56) References Cited

U.S. PATENT DOCUMENTS 979,296 A 12/1910 Heissenberger
1,169,637 A * 1/1916 Grove ..... B26B 21/446 30/41
1,288,869 A 12/1918 Ganzhorn
1,444,764 A 2/1923 Rodhe et al.
1,453,014 A 4/1923 Kohn
1,599,482 A * 9/1926 Moore ..... B26B 21/18 30/81
1,633,139 A 6/1927 Staats-oels
1,741,891 A 12/1929 Vallon
1,744,902 A 1/1930 Johnston
1,825,335 A 9/1931 Connolly
(Continued)

FOREIGN PATENT DOCUMENTS

DE 630053 C 5/1936
DE 679564 C 8/1939
(Continued)

*Primary Examiner* — Jason Daniel Prone
(74) *Attorney, Agent, or Firm* — Klarquist Sparkman, LLP

(57) ABSTRACT

A safety razor comprise a handle and a head portion. The handle has a first end portion and a second end portion. The head portion is removably coupled to the first end portion of the handle and has a guard, a replaceable blade, a replaceable lubrication member, and a cap. The lubrication member has one or more lubrication strips. The cap has one or more openings formed therein and a projection extending therefrom. The projection is configured to extend through the lubrication member, the blade, the guard, and into the handle to removably couple the head portion to the handle. The lubrication strips of the lubrication member extend through the openings of the cap. The safety razor can include a second lubrication member or a skin tensioning member.

8 Claims, 17 Drawing Sheets

(56) References Cited

U.S. PATENT DOCUMENTS 1,856,305 A * 5/1932 Witter ..... B26B 21/18 30/41
1,871,010 A * 8/1932 Robb ..... B26B 21/18 30/41
1,892,836 A 1/1933 Harvey
1,920,711 A 8/1933 Pelizzola
1,923,439 A 8/1933 Hukill
1,935,452 A 11/1933 Kondolf
1,938,481 A * 12/1933 Black ..... B26B 21/18 30/41
1,975,757 A 10/1934 Gray
2,040,345 A 5/1936 Taylor
2,085,892 A * 7/1937 Bodkin ..... B26B 21/18 30/41
2,086,426 A * 7/1937 Mackenzie ..... B26B 21/20 30/41
2,120,940 A 6/1938 Minassian
2,143,276 A * 1/1939 Martin ..... B26B 21/18 30/41
2,183,554 A * 12/1939 Evans ..... B26B 21/18 30/41
2,292,418 A 8/1942 Wetherbee
2,299,868 A 10/1942 Younghusband
2,313,895 A 3/1943 Savary
2,319,980 A 5/1943 Des Jardins
2,327,967 A 8/1943 Peters
2,336,806 A 12/1943 Schenk et al.
2,363,040 A 11/1944 Barthalot
2,374,612 A 4/1945 Mellon
2,375,444 A 5/1945 Schwartz
2,389,470 A 11/1945 Traynham
2,392,975 A 1/1946 Cooney
2,424,260 A * 7/1947 Testi ..... B26B 21/18 30/65
2,548,959 A 4/1951 Eisenberg et al.
2,558,601 A * 6/1951 Winslow ..... B26B 21/18 30/84
2,568,047 A 9/1951 Anderson
2,593,306 A 4/1952 Jacobsen
2,593,307 A 4/1952 Jacobsen
2,600,880 A * 6/1952 Karle ..... B26B 21/44 30/41
2,677,883 A 5/1954 Schallgruber
2,698,995 A 1/1955 Anastasia
2,766,521 A 10/1956 Benvenuti
2,793,431 A * 5/1957 Fortin ..... B26B 21/18 30/59
2,795,847 A * 6/1957 Arnade ..... B26B 21/18 30/70
2,837,820 A 6/1958 Ostrowski
2,839,224 A * 6/1958 Lipka ..... B26B 21/446 30/41
2,861,338 A 11/1958 Boland
3,138,865 A 6/1964 Meyer
3,139,683 A 7/1964 Waldman
3,417,468 A 12/1968 Miyauchi
3,477,127 A 11/1969 Regan
3,626,591 A * 12/1971 Robey ..... B26B 21/00 30/54
3,748,735 A * 7/1973 Whittington ..... B26B 21/18 30/70
3,768,161 A 10/1973 Miller
3,777,396 A 12/1973 Simonetti
3,802,072 A 4/1974 Wintercorn
3,895,437 A 7/1975 DiBuono
3,969,817 A 7/1976 DiBuono
4,170,821 A 10/1979 Booth
4,189,832 A 2/1980 Harper et al.
4,314,404 A 2/1982 Ruiz et al.
4,562,644 A 1/1986 Hitchens
4,641,429 A 2/1987 Abatemarco
4,872,263 A 10/1989 Etheredge, III
5,036,587 A 8/1991 Trotta et al.
5,095,620 A 3/1992 Althaus
5,430,939 A 7/1995 Johnston
5,454,164 A 10/1995 Yin et al.
5,590,468 A 1/1997 Prochaska
6,385,850 B1 * 5/2002 Coulthard, Jr. ..... B26B 21/22 30/41.5
6,532,667 B1 3/2003 Leaseburge
6,993,846 B2 2/2006 Orloff
9,505,142 B2 11/2016 Nordstrom
9,840,014 B2 * 12/2017 Gilor ..... B26B 21/18 30/51
2012/0102741 A1 * 5/2012 Pesikov ..... B26B 21/44 30/41
2015/0107114 A1 4/2015 Minsk et al.
2015/0352737 A1 12/2015 Hickam
2015/0360375 A1 * 12/2015 Wertz ..... B26B 21/18 30/52
2016/0250761 A1 9/2016 Zoller et al.
2017/0297212 A1 10/2017 Nordstrom

FOREIGN PATENT DOCUMENTS

DE 862273 C 1/1953
DE 863917 C 1/1953
DE 870214 C 3/1953
DE 102013010990 A1 1/2015
FR 860727 A 1/1941
GB 155450 A 12/1920
GB 147695 A 4/1921
GB 153279 A 8/1921
GB 396541 A 8/1933
WO WO 2016/207677 A1 12/2016

* cited by examiner

SAFETY RAZOR

CROSS REFERENCE TO RELATED APPLICATIONS

This application is a continuation-in-part of U.S. application Ser. No. 15/081,386, filed filed Mar. 25, 2016 (now U.S. Pat. No. 9,840,014 B2). This application also claims the benefit of European Application No. 17001490.6, filed Sep. 5, 2017. Both related applications are incorporated by reference herein.

FIELD

The present disclosure generally concerns safety razors, and more particularly, lubrication devices and systems for safety razors.

BACKGROUND

Safety razors are shaving devices that typically have a handle, a single, replaceable blade, and a protective guard positioned adjacent an edge of the blade to protect a user's skin from full exposure to the edge of the blade. Safety razors were developed as a relatively safer and/or easier to use alternative to straight edge razors. There are various types of blades for safety razors including single-edge and double-edge blades.

Although safety razors have been around for over a hundred years, disposable razors (including cartridge razors) are the most commonly used type of razors today. Nevertheless, in recent years, safety razors are regaining popularity due to, inter alia, long term cost savings over disposable razors because replacement blades for safety razors are relatively inexpensive.

Despite regaining popularity, safety razors have remained essentially unchanged for many years. As a result, there is a continuing need for improved safety razors.

SUMMARY

Described herein are embodiments of safety razors, as well as lubrication devices and systems for safety razors, comprising at least one lubrication member. These lubrication members can be used to lubricate a user's skin while shaving and to reduce friction and skin irritation caused by a blade during shaving.

In one representative embodiment, a safety razor comprises a handle portion having a first end portion and a second end portion and a longitudinal axis extending from the first end portion to the second end portion, and a head portion that is removably coupled to the first end portion of the handle and includes a guard member, a replaceable blade member having at least one cutting edge portion, a replaceable lubrication member comprising a lubrication substance, and a cap member having a projection that is configured to extend through the lubrication member, the blade member, and the guard member and to extend into the handle portion, wherein the lubrication member, the blade member, and the guard member have centrally disposed openings through which the projection of the cap member extends, and wherein the blade member and the lubrication member are independently removable and replaceable relative to each other and the head portion.

In some embodiments, the lubrication member is relatively rigid such that the lubrication member maintains its shape when a user presses the lubrication member against the user's skin. In some embodiments, wherein the lubrication member has a rounded edge portion that extends laterally beyond the cap member, and the lubricating substance disposed on the rounded edge portion of the lubrication member.

In some embodiments, the lubricating substance is a lubricating coating that is applied to a portion of the lubrication member. In other embodiments, the lubricating substance is a lubricating strip that is attached to a portion of the lubrication member.

In some embodiments, the head portion is removably coupled to the handle portion such that the at least one cutting edge of the blade member is perpendicular to the longitudinal axis of the handle portion, and the lubrication member has a lubricating edge portion that is parallel to the at least one cutting edge portion of the blade member and to which the lubricating substance is applied or attached.

In some embodiments, the blade member has a first cutting edge portion disposed on a first side portion of the blade member and a second cutting edge portion disposed on a second side portion of the blade member, and the head portion is removably coupled to the handle portion such that the first and the second cutting edge portions are perpendicular to the longitudinal axis of the handle portion, and wherein the lubrication member has a first edge portion disposed on a first side portion of the lubrication member and a second edge portion disposed on a second side portion of the lubrication member, and the first and the second edge portions of the lubrication member are parallel to the first and the second cutting edge portions of the blade member.

In some embodiments, the head portion further includes a spacer member having a centrally disposed opening through which the projection of the cap member can extend, wherein the spacer is disposed between the blade and the lubrication member and is configured to space the lubrication member and the blade member relative to each other along an axis extending through the central openings of the blade member and the lubrication member.

In some embodiments, the lubrication member is a first lubrication member that is disposed between the cap member and the blade member, and the head portion further comprises a second lubrication member that is disposed the guard member and the handle portion and that has a centrally disposed opening through which the projection of the cap member can extend. In some of those embodiments, the first and the second lubrication members and the blade member are independently removable and replaceable relative to each other and the head portion. In some of those embodiments, the first lubrication member extends laterally past the cap member, and the second lubrication member extends laterally beyond the guard member.

In some embodiments, the lubrication member is a plurality of lubrication members and at least two of the lubrication members are disposed the handle portion and the cap member of the head portion.

In another representative embodiment, a lubrication system for a safety razor is provided. The lubrication system comprises a spacer member, a replaceable lubrication member, and a lubricating substance which is applied or attached to the lubrication member, wherein the spacer member and the lubrication member have centrally disposed openings configured to removably receive a portion of a safety razor.

In some embodiments, the lubrication member is a first lubrication member, and the lubrication system further comprises a second lubrication member, wherein the lubricating substance is applied or attached to the first and the second lubrication members, and the first and the second lubrication members have centrally disposed openings, configured to removably receive a portion of a safety razor.

In another representative embodiment, a method of replacing a lubrication member is provided. The method comprises detaching a handle portion of safety razor from a head portion of the safety razor, decoupling a lubrication member from a blade member, coupling a new lubrication member to the head portion, reattaching the head portion to the handle portion.

In some embodiments, the new lubrication member is coupled to the head portion between the blade member and a cap member. In other embodiments, the new lubrication member is coupled to the head portion between the blade member and the handle portion.

In some embodiments, the step of decoupling the lubrication member from the blade member includes removing a projection of a cap member from a centrally disposed opening in the lubrication member.

In some embodiments, the lubrication member is a first lubrication member and the new lubrication member is a first new lubrication member, and the method further comprises decoupling a second lubrication member from the blade member and coupling a second new lubrication member to the head portion. In some of those embodiments, the first lubrication member is coupled to the head portion between the blade member and the handle portion, and the second lubrication member is coupled to the head portion between the blade member and a cap member.

In yet another representative embodiment, a safety razor comprises a handle and a head portion. The handle has a first end portion and a second end portion. The head portion is removably coupled to the first end portion of the handle and has a guard, a replaceable blade, a replaceable lubrication member, and a cap. The lubrication member comprises one or more lubrication strips. The cap has one or more openings formed therein and a projection extending therefrom. The projection is configured to extend through the lubrication member, the blade, the guard, and into the handle to removably couple the head portion to the handle. The lubrication strips of the lubrication member extend through the openings of the cap.

In some embodiments, the lubrication member is a first lubrication member, and the lubrication strips are first lubrication strips. The head portion further includes a second lubrication member disposed between the guard and the handle and having one or more second lubrication strips.

In some embodiments, the head portion further includes a skin tensioning member disposed between the guard and the handle.

In some embodiments, the blade and the lubrication member are independently removable and replaceable relative to each other and the head portion.

In some embodiments, the lubrication member is configured to nest under the cap such that at least a portion of the cap directly contacts the blade.

In some embodiments, the lubrication member comprises a first side portion and a second side portion, and the one or more lubrication strips includes at least one lubrication strip disposed on the first side portion of the lubrication member and at least one other lubrication strip disposed on the second side portion of the lubrication member.

In some embodiments, the one or more openings of the cap includes at least one opening formed in a first side portion of the cap and configured for receiving the at least one lubrication strip disposed on the first side portion of the lubrication member and at least one other opening formed in a second side portion of the cap and configured for receiving the at least one other lubrication strip disposed on the second side portion of the lubrication member.

In some embodiments, the blade is a single blade having a first cutting edge disposed on a first side of the blade and a second cutting edge disposed on a second side of the blade.

In yet another representative embodiment, a safety razor comprises a handle and a head portion. The handle has a first end portion and a second end portion. The head portion is removably coupled to the first end portion of the handle and has a replaceable lubrication member, a guard, a replaceable blade, and a cap. The lubrication member has one or more lubrication strips. The guard has one or more notches configured for receiving the lubrication strips of the lubrication member. The blade has at least one cutting edge. The cap has a projection extending therefrom. The projection is configured to extend through the blade, the guard, and the lubrication member and into the handle to removably couple the head portion to the handle.

In some embodiments, the guard extends laterally beyond the lubrication strips adjacent the notches of the guard.

In some embodiments, the lubrication member is a first lubrication member, and the lubrication strips are first lubrication strips, and wherein the head portion further includes a second lubrication member disposed at least partially between the blade and the cap and having one or more second lubrication strips.

In some embodiments, the cap includes one or more openings, and the second lubrication strips of the second lubrication member extend through the openings of the cap.

In yet another representative embodiment, a safety razor comprises a handle and a head portion. The handle has a first end portion and a second end portion. The head portion is removably coupled to the first end portion of the handle and has a skin tensioning member, a guard, a replaceable blade, and a cap. The guard has one or more notches configured for receiving the skin tensioning member. The cap has a projection extending therefrom. The projection is configured to extend through the blade, the guard, and the skin tensioning member and into the handle to removably couple the head portion to the handle.

In some embodiments, the guard extends laterally beyond the skin tensioning member adjacent the notches of the guard.

In some embodiments, the cap includes one or more openings, and wherein the head portion further includes a lubrication member having one or more lubrication strips, and the lubrication strips extend through the openings of the cap.

The foregoing and other objects, features, and advantages of the invention will become more apparent from the following detailed description, which proceeds with reference to the accompanying figures.

DETAILED DESCRIPTION

Figure 1:
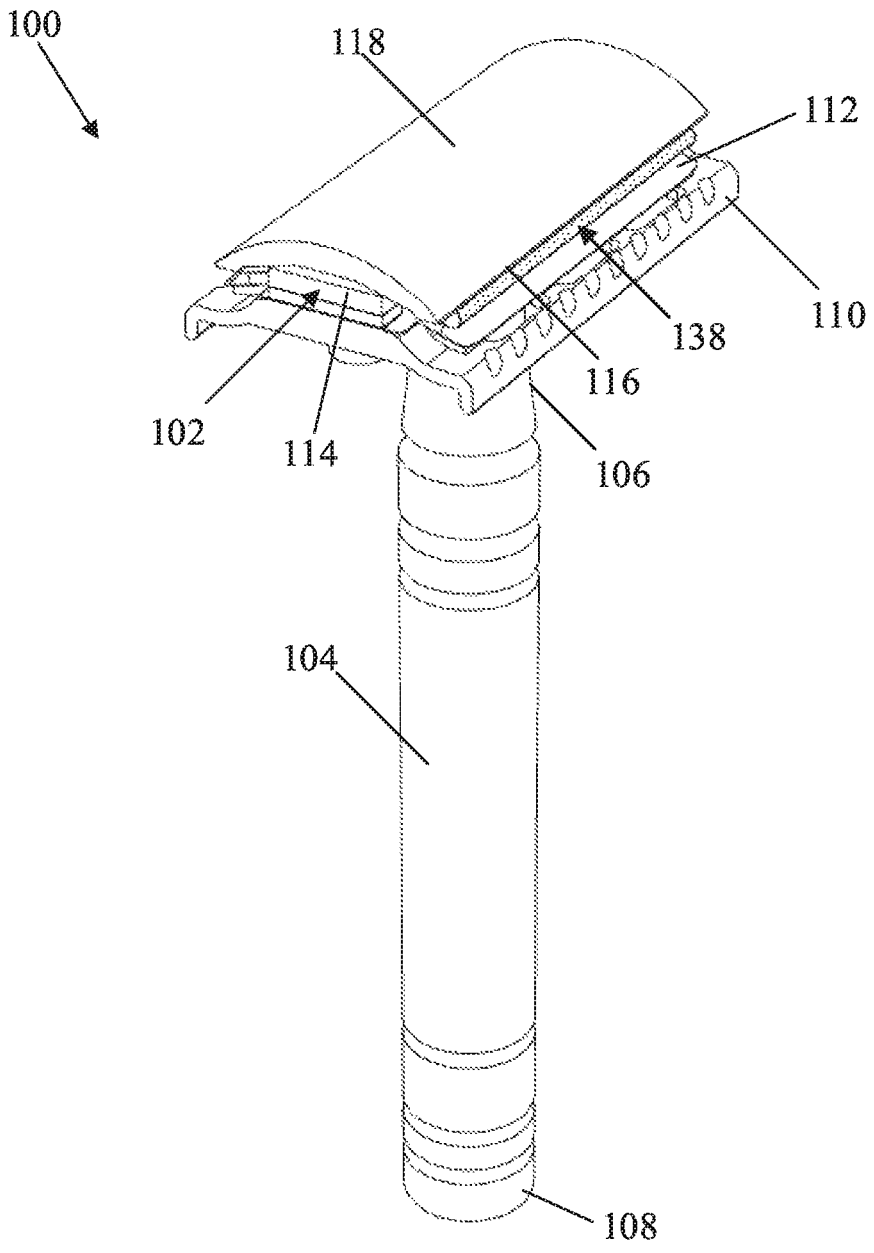
FIG. 1 is a perspective view of an exemplary embodiment of a safety razor.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. For example, the features of safety razor 100 can be combined with features of safety razor 200, and vice versa. The methods, apparatuses, and systems are not limited to any specific aspect or feature or combination thereof, nor do the disclosed embodiments require that any one or more specific advantages be present or problems be solved.

Integers, characteristics, materials, and other features described in conjunction with a particular aspect, embodiment, or example of the disclosed technology are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The disclosed technology is not restricted to the details of any foregoing embodiments. The disclosure extends to any novel one, or any novel combination, of the features disclosed in this specification (including any accompanying claims, abstract and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language. For example, operations described sequentially may in some cases be rearranged or performed concurrently. Moreover, for the sake of simplicity, the attached figures may not show the various ways in which the disclosed methods can be used in conjunction with other methods.

As used herein, the terms "a", "an", and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A", "B,", "C", "A and B", "A and C", "B and C", or "A, B, and C."

As used herein, the term "coupled" generally means physically coupled or linked and does not exclude the presence of intermediate elements between the coupled items absent specific contrary language.

Described herein are embodiments of safety razors, as well as lubrication devices and systems for safety razors, comprising at least one lubrication member. These lubrication members can be used to lubricate a user's skin while shaving and to reduce friction and skin irritation caused by a blade during shaving.

In some embodiments, a safety razor can comprise one lubrication member. In some of those embodiments, the lubrication member can be disposed above the blade. In other such embodiments, the lubrication member can be disposed below the blade.

In other embodiments, a safety razor can comprise more than one lubrication member. For example, in some of those embodiments, a safety razor can comprise a first lubrication member disposed above the blade and a second lubrication member disposed below the blade. In other such embodiments, a safety razor can comprise more than two lubrication members (e.g., three, four, five, six, etc.).

It should be noted that although illustrated embodiments are directed toward double-edge ("DE") safety razors (i.e., safety razors with double-edge blades), single-edge ("SE") safety razors (i.e., safety razors with single-edge blades) can be used.

FIGS. 1-6 show a DE safety razor 100, according to one exemplary embodiment. Referring first to FIG. 1, the safety razor 100 can comprise two main components: a head portion 102 and a handle portion 104. The head portion 102 can be removably coupled to a first end 106 of the handle portion 106 and can be perpendicular, or at least substantially perpendicular, to a longitudinal axis of the handle portion 104 which extends from the first end 106 to a second end 108 of the handle portion 104.

Figure 6:
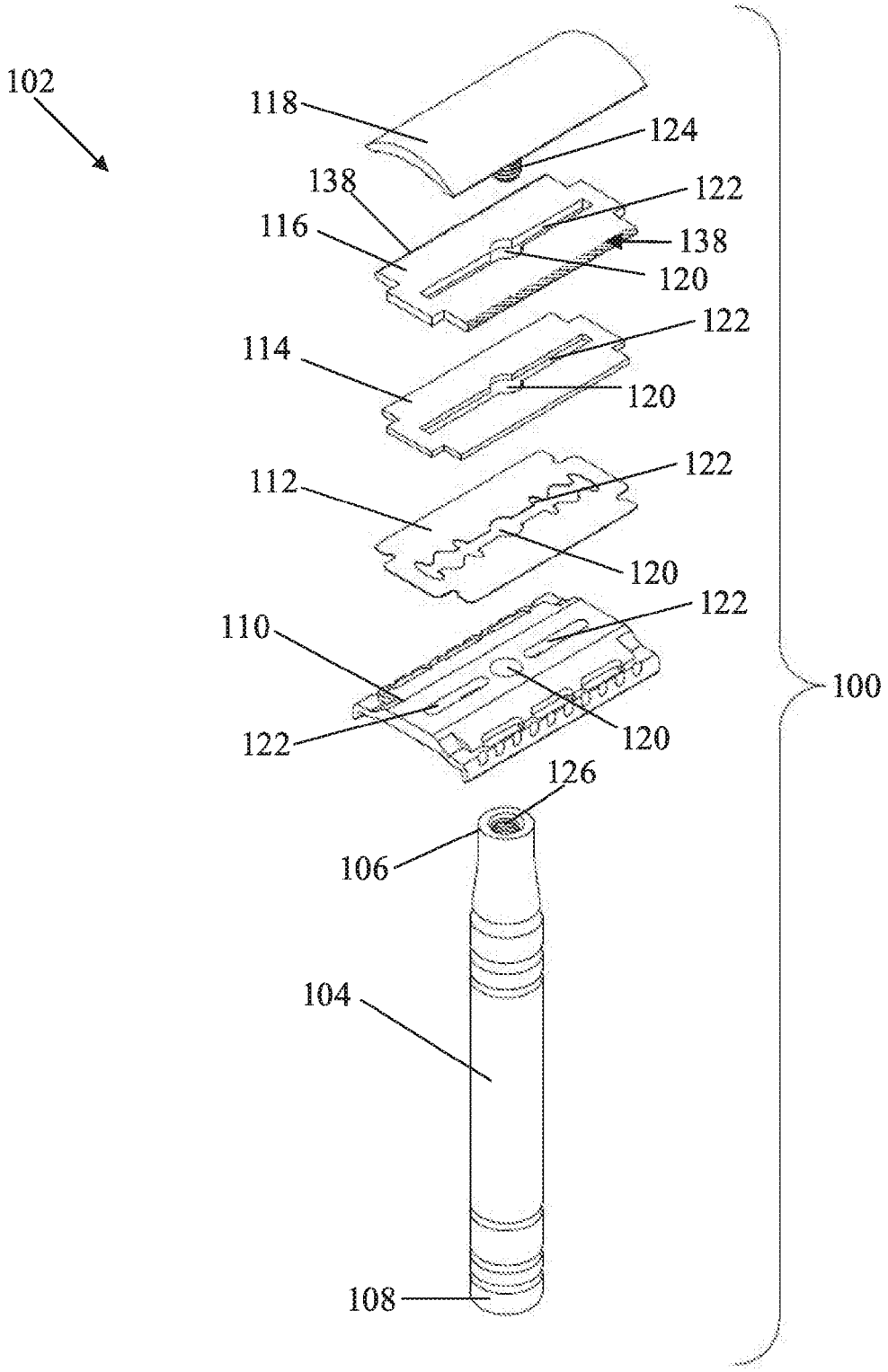
FIG. 6 is an exploded view of the safety razor of FIG. 1.

Referring to FIG. 6, the head portion 102 of the safety razor 100 can comprise a guard member 110, a blade member 112, a spacer member 114, a lubrication member 116, and a cap member 118 (collectively referred to as "the components of the head portion 102"). The components of the head portion 102 can be arranged in various ways. For example, referring to FIG. 2, the guard member 110 can be disposed on the bottom of the head portion 102, adjacent the handle portion 104, and then moving from the bottom of the head portion 102 toward the top of the head portion 102 (i.e., upward as illustrated in FIG. 2), the blade member 112 can be disposed above the guard member 110, the spacer member 114 can be disposed above the blade member 112, the lubrication member 116 can be disposed above the spacer member 114, and the cap member 118 can be disposed above the lubrication member 116 at the top of the head portion 102.

Figure 2:
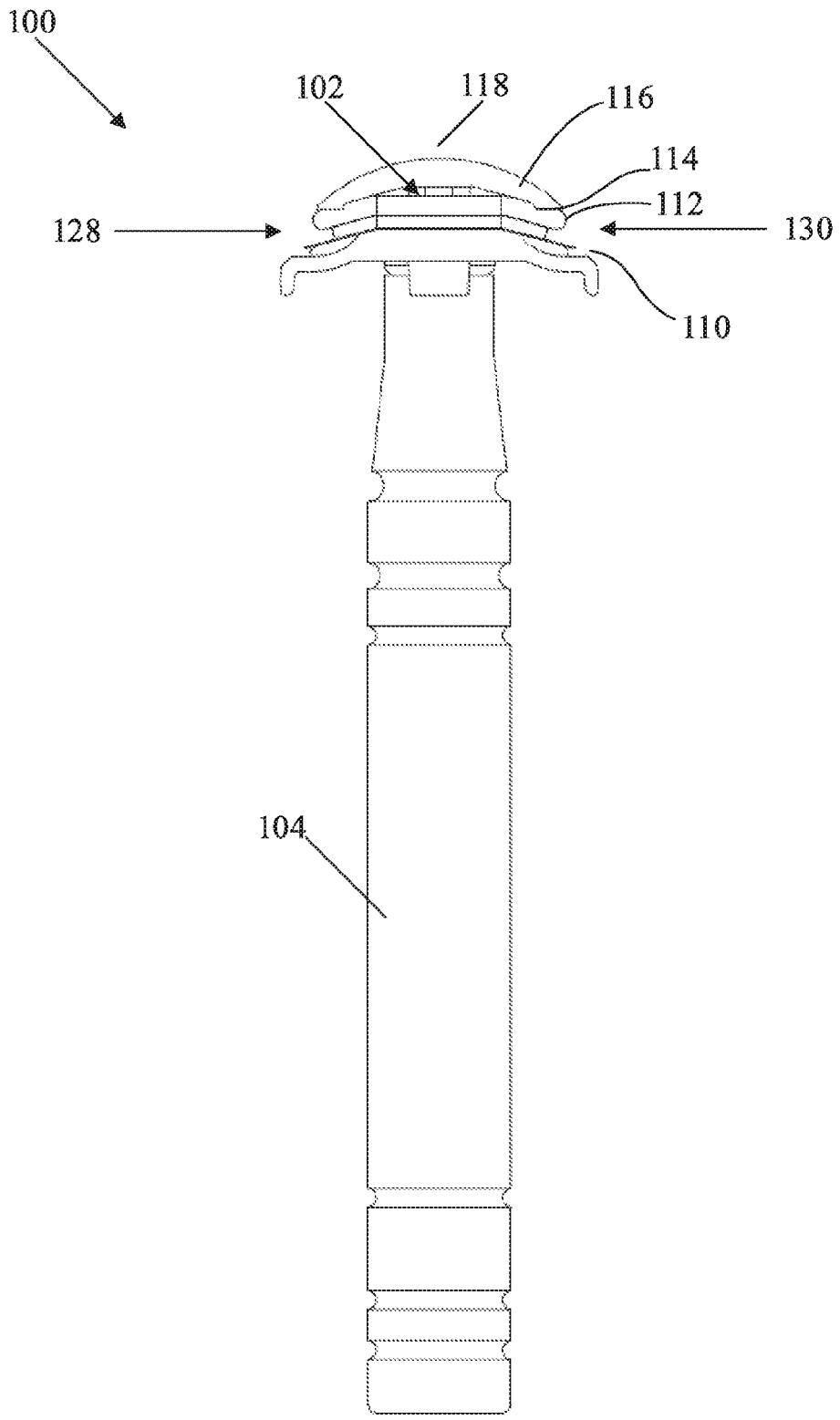
FIG. 2 is an end view of the safety razor of FIG. 1.

Referring still to FIG. 2, the components of the head portion 102 can comprise various dimensions in the lateral direction (i.e., the distance between first and second sides 128, 130 of the respective components of the head portion 102). For example, as shown in the illustrated embodiment, the guard member 110 can be laterally larger than the blade member 112, the spacer member 114, the lubrication member 116, and the cap member 114. The blade member 112 can be laterally larger than the spacer member 114, the lubrication member 116, and the cap member 114. The lubrication member 116 can be laterally larger than the spacer member 114 and the cap member 114. The cap member 118 can be laterally larger than the spacer member 114.

In other embodiments, the lubrication member 116 can be disposed below the blade member 112, and the spacer member 114 can be disposed above the lubrication member 114 and below the blade member 112. In such embodiments, the guard member 110 can be laterally larger than the blade member 112, the spacer member 114, the lubrication member 116, and the cap member 114. The lubrication member 116 can be laterally larger than the spacer member 114, the blade member 112, and the cap member 114. The blade member 112 can be laterally larger than the spacer member 114 and the cap member 114. The cap member 118 can be laterally larger than the spacer member 114.

Figure 5:
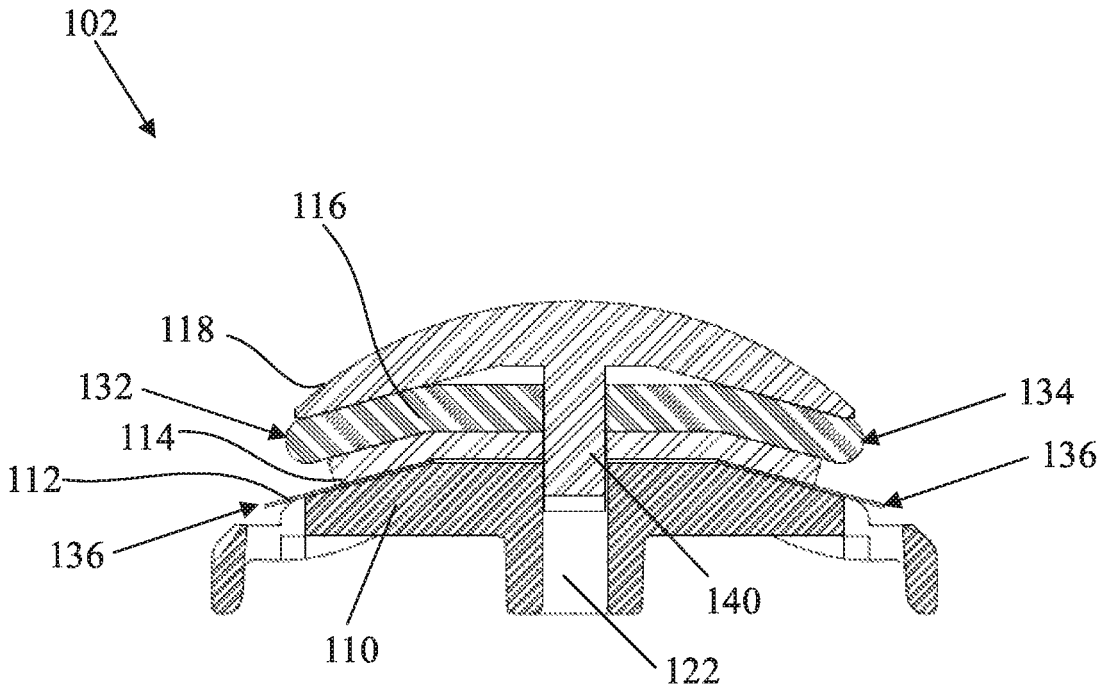
FIG. 5 is a cross-sectional view of the safety razor of FIG. 1, taken along the line 5-5 as shown in FIG. 3.

Referring to FIG. 5, the lubrication member 116 can have first and second edge portions 132, 134. The first and second edge portions 132, 134 can be parallel, or at least substantially parallel, to cutting edge portions 136 of the blade member 112 such that the first and second edges 132, 134 can contact a user's skin when a cutting edge portion 136 of the blade member 112 contacts the user's skin. The first and second edge portions 132, 134 can comprise various configurations (e.g., flat, rounded, angled, etc.). For example, as shown in the illustrated embodiment, the first and second edge portions 132, 134 can be rounded edges, which allows the first and second edge portions 132, 134 to contact the user's skin at various angles.

The lubrication member 116 can be formed of various materials, including polymers, metals, etc. In some embodiments, the lubrication member 116 can be relatively rigid such that the lubrication member 116 can maintain its shape when a user presses the lubrication member 116 against the user's skin. In yet other embodiments, the lubrication member 116 can be relatively flexible such that the lubrication member 116 can bend or flex when a user presses the lubrication member 116 against the user's skin.

Figure 3:
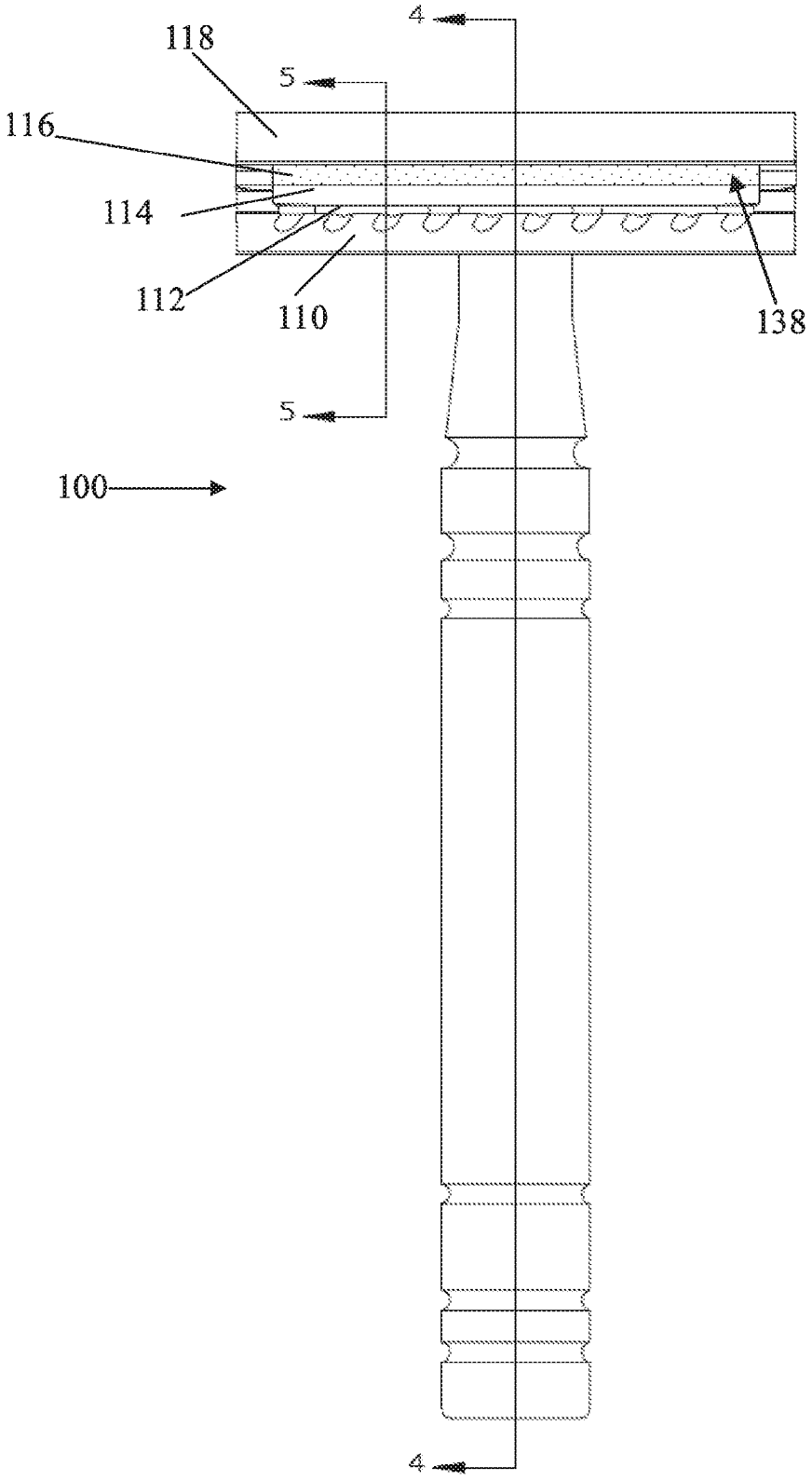
FIG. 3 is a side view of the safety razor of FIG. 1.

The lubrication member 116 can comprise a lubricating substance 138 which can, for example, be attached to the first and second edge portions 132, 134 of the lubrication member 116, as best shown in FIGS. 1, 3, and 6. For example, in some embodiments, the lubricating substance 138 can be a coating that is applied to the surface of the lubrication member 116. In other embodiments, the lubricating substance 138 can be applied to a lubrication strip that is attached to the lubrication member 116 (e.g., with an adhesive). In yet other embodiments, the lubricating substance 138 can be applied to an insert that clips, snaps, slides, and/or is otherwise removably coupled to the lubrication member 116.

The lubricating substance 138 can be formed from various materials, such as polyethylene oxide. The lubricating substance 138 can be configured to lubricate the user's skin as the user moves the safety razor 100 along the user's skin, thereby reducing the resistance (e.g., drag) of the safety razor 100 on the user's skin. This in turn can advantageously reduce skin irritation caused by the cutting edge portion 136 of the blade member pressing against and moving along the user's skin. Additional information regarding lubricants that can be used as lubricating substance 138 can be found, for example, in U.S. Pat. Nos. 5,454,164, 4,872,263, and 4,170,821, which are incorporated herein by reference.

The spacer member 114 can be formed of various materials, including polymers, metals, etc. In some embodiments, the spacer member 114 and the lubrication member 116 can be integrally formed as a single, unitary piece. In other embodiments, the spacer member 114 and the lubrication member can be formed as separate pieces which are fixedly secured together (e.g., with an adhesive, fasteners, etc.). In other embodiments, the spacer member 114 and the lubrication member 116 can be formed as separate piece that are removably coupled together (e.g., with the cap member 118 as further described below).

Figure 4:
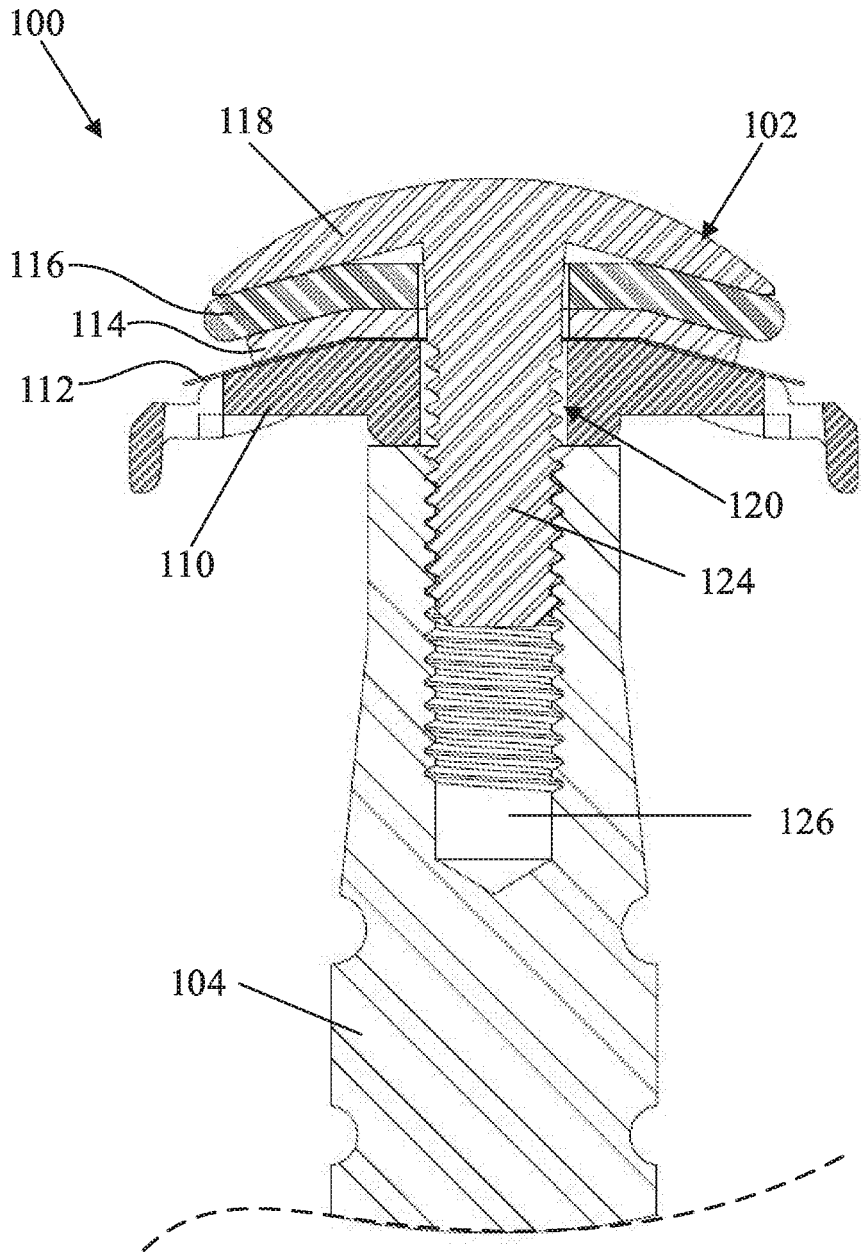
FIG. 4 is a partial cross-sectional view of the safety razor of FIG. 1, taken along the line 4-4 as shown in FIG. 3.

The components of the head portion 102 can include mating features configured to align and to prevent relative movement of the components of the head portion 102 when the head portion 102 is removably coupled to the handle portion 104. For example, referring again to FIG. 6, the guard member 110, the blade member 112, the spacer member 114, and the lubrication member 116 can include centrally disposed openings 120 and one or more slots 122 disposed adjacent and/or extending from the openings 120. Referring now to FIG. 4, the cap member 118 can include a centrally disposed projection 124 that extends from a bottom portion of the cap member 118. The projection 124 of the cap member 118 can be configured to extend through the openings 120 of the lubrication member 116, the spacer member 114, the blade member 112, and the guard member 110, and to extend into a recess 126 formed in the first end portion 106 of the handle portion 104. Referring now to FIG. 5, the cap member 118 also can include at least one tab or ridge 140 that extends from a bottom portion of the cap member 118, adjacent the projection 124. The tab 140 can be configured to extend through the openings 122 of the lubrication member 116, the spacer member 114, the blade member 112, and the guard member 110. In this manner, the projection 124 and the tab 140 of the cap member 118 can respectively engage the openings 120 and the slots 122 of the lubrication member 116, the spacer member 114, the blade member 112, and the guard member 110, thereby aligning and preventing relative movement of the components of the head portion 102 when the head portion 102 is coupled to the handle portion 104.

The projection 124 of the cap member 118 can also be used to removably couple the head portion 102 to the handle portion 104. For example, as shown in FIG. 4, the projection 124 of the cap member 118 can include external threads that are configured to engage corresponding internal threads formed in the recess 126 of the handle portion 104. In such embodiments, the safety razor 100 can be assembled by inserting the projection 124 of the cap member 118 through the components of the head portion 102 and into the recess 126 of the handle portion 104 and by rotating the handle portion 104 in a first direction (e.g., clockwise) relative to the head portion 102 until the head portion 102 is firmly secured to the handle portion 104. The safety razor 100 can be disassembled by rotating the handle portion 104 in a second direction (e.g., counterclockwise) relative to the head portion 102 until the head portion 102 is released from the handle portion 104.

In other embodiments, the head portion 102 can be removably coupled to the handle portion 104 in various other ways, including a snap-fit type connection, fasteners (e.g., bolts or screws), etc.

Figure 7:
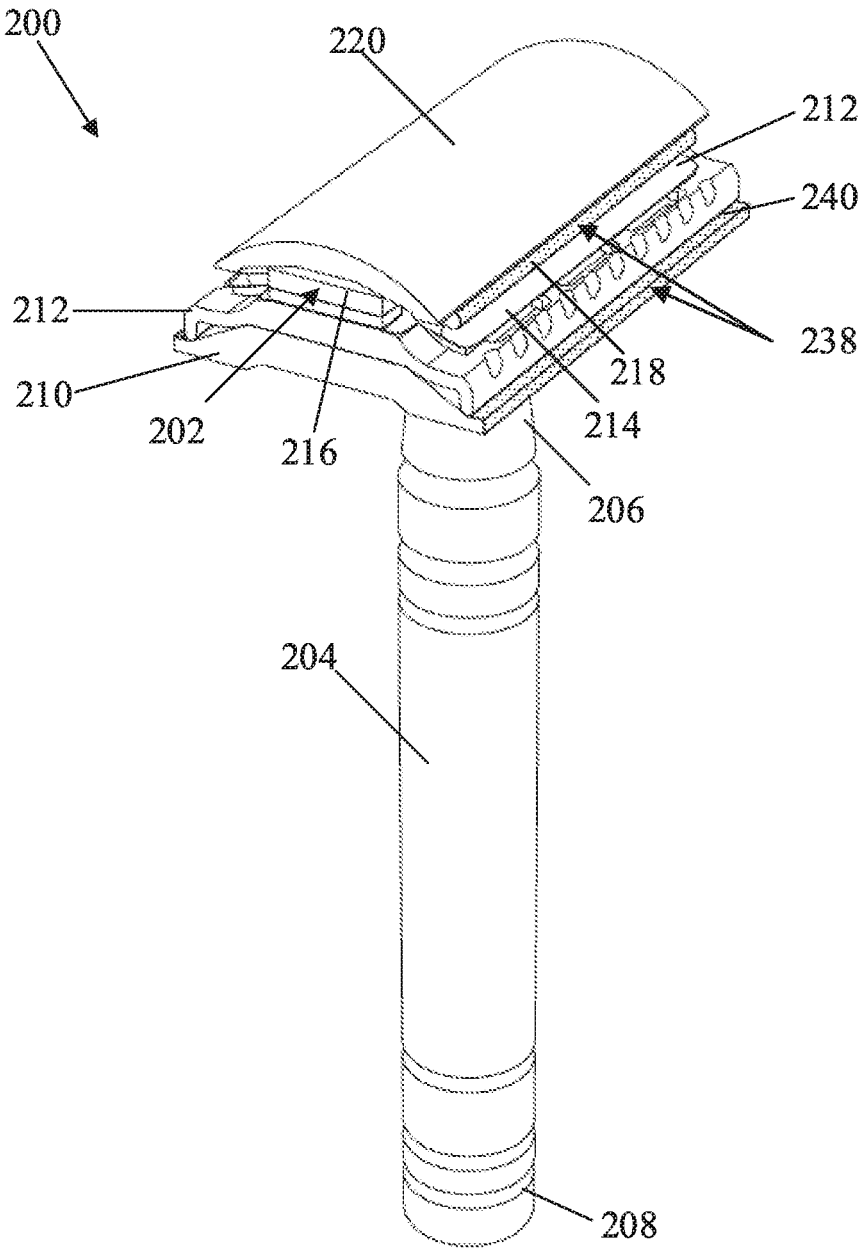
FIG. 7 is a perspective view of another exemplary embodiment of a safety razor.

FIGS. 7-12 show a DE safety razor 200, according to another exemplary embodiment. Referring first to FIG. 7, the safety razor 200 can comprise two main components: a head portion 202 and a handle portion 204. The head portion 202 can be removably coupled to a first end 206 of the handle portion 204 and can be perpendicular, or at least substantially perpendicular, to a longitudinal axis of the handle portion 204 which extends from the first end 206 to a second end 208 of the handle portion 204.

Figure 12:
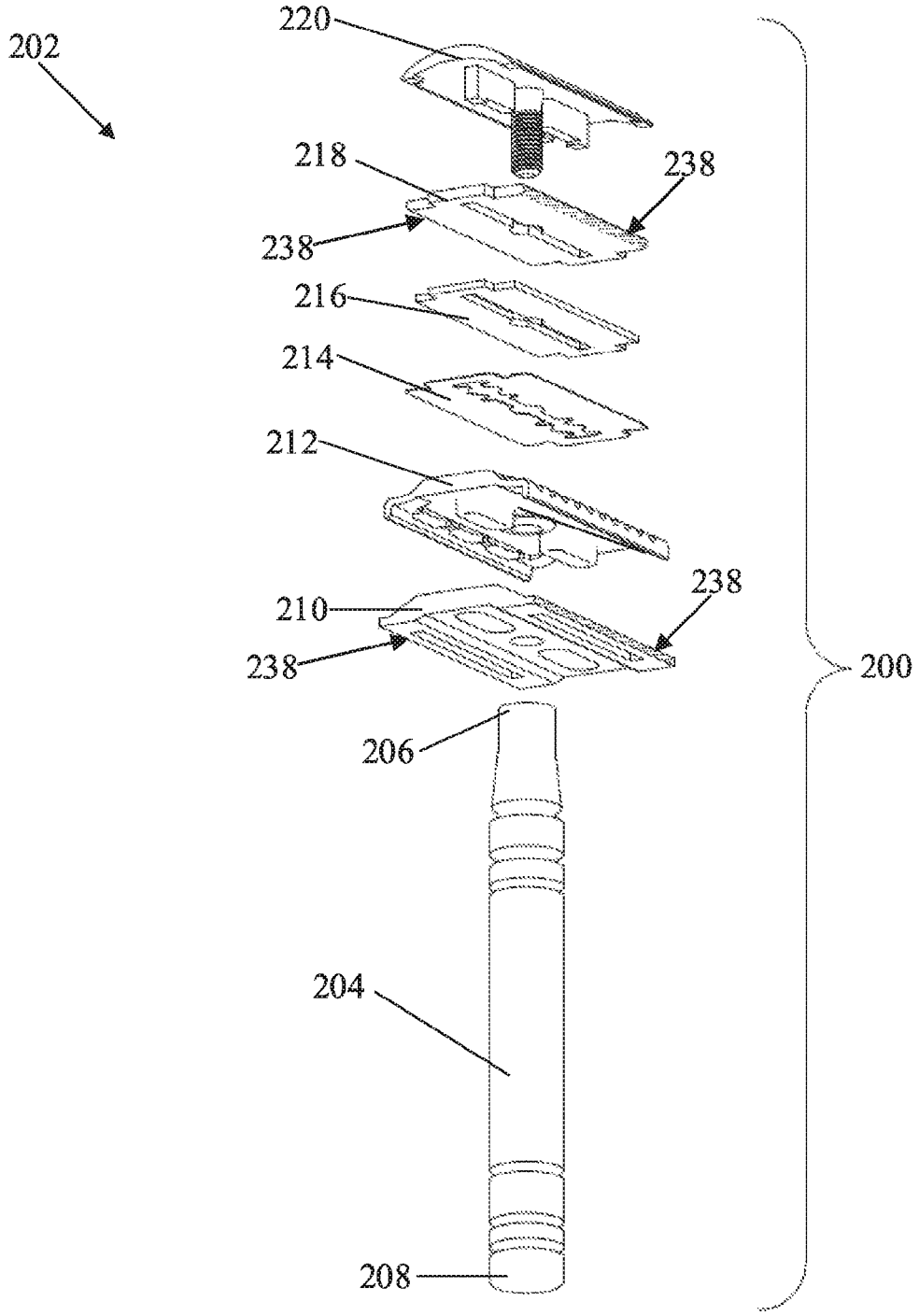
FIG. 12 is an exploded view of the safety razor of FIG. 7.

Referring to FIG. 12, the head portion 202 of the safety razor 200 can comprise a first lubrication member 210, a guard member 212, a blade member 214, a spacer member 216, a second lubrication member 218, and a cap member 220 (collectively referred to as "the components of the head portion 202"). The components of the head portion 202 can be arranged in various ways. For example, referring to FIG. 8, the first lubrication member 210 can be disposed on the bottom of the head portion 202 adjacent the handle portion 204, and then moving from the bottom of the head portion 202 toward the top of the head portion 202 (i.e., upward as illustrated in FIG. 8), the guard member 212 can be disposed above the first lubrication member 210, the blade member 214 can be disposed above the guard member 212, the spacer member 216 can be disposed above the blade member 214, the second lubrication member 218 can be disposed above the spacer member 216, and the cap member 220 can be disposed above the second lubrication member 218 at the top of the head portion 202.

Figure 8:
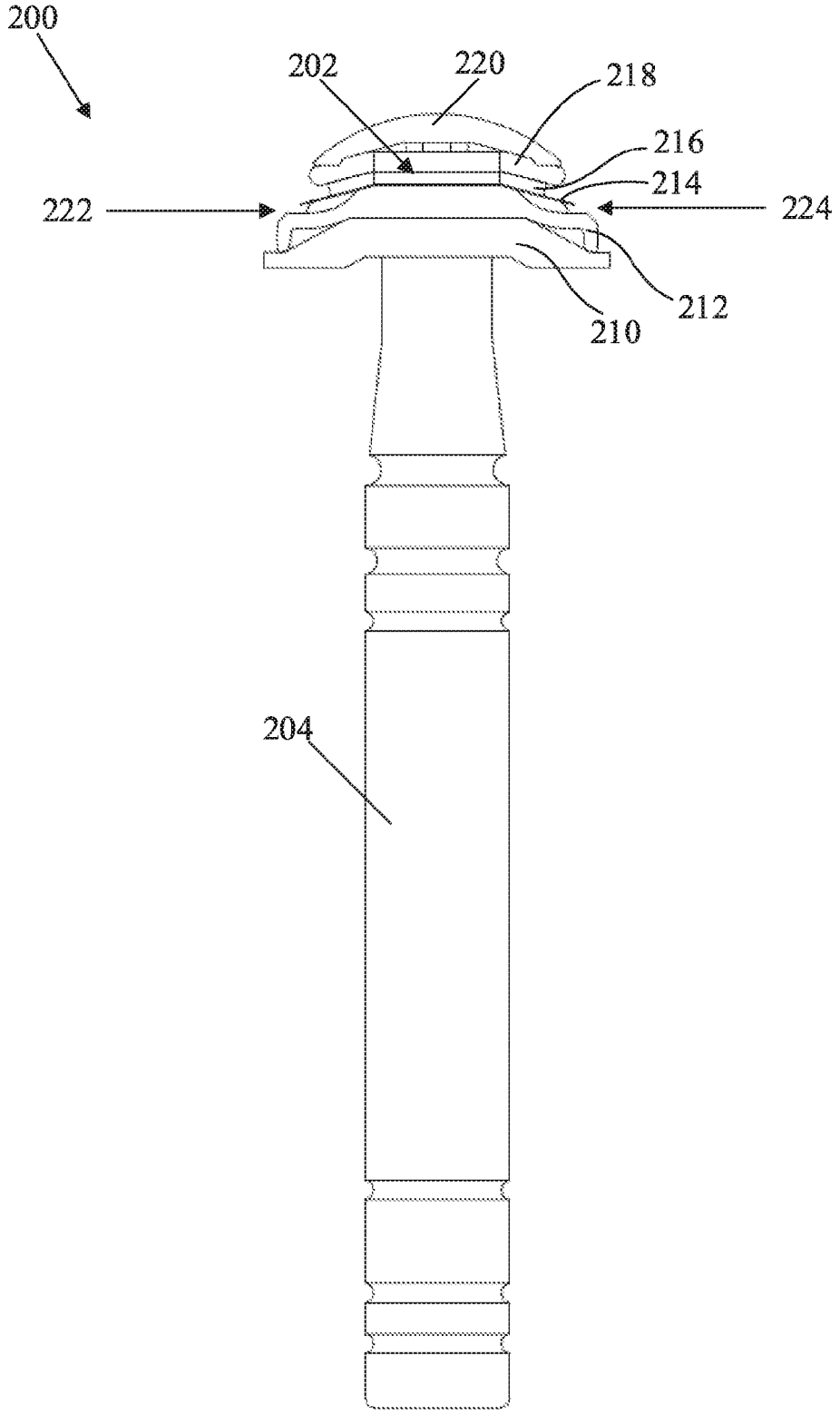
FIG. 8 is an end view of the safety razor of FIG. 7.

Referring still to FIG. 8, the components of the head portion 202 can comprise various dimensions in the lateral direction (i.e., the distance between first and second sides 222, 224 of the respective components of the head portion 202). For example, as shown in the illustrated embodiment, the first lubrication member 210 can be laterally larger than the guard member 212, the blade member 214, the spacer member 216, the second lubrication member 218, and the cap member 220. The guard member 212 can be laterally larger than the blade member 214, the spacer member 216, the second lubrication member 218, and the cap member 220. The blade member 214 can be laterally larger than the spacer member 216, the second lubrication member 218, and the cap member 220. The cap member 220 can be laterally larger than the spacer member 216.

In other embodiments, the first lubrication member 210 and/or the second lubrication member 218 can be disposed above the guard member 212 and below the blade member 214. In such embodiments, the guard member 212 can be laterally larger than the first and/or second lubrication member 210, 218, the blade member 214, the spacer member 216, and the cap member 220. The first and/or second lubrication members 210, 218 can be laterally larger than the blade member 214, the spacer member 216, and the cap member 220. The blade member 214 can be laterally larger than the spacer member 216, and the cap member 220. The cap member 220 can be laterally larger than the spacer member 216. In some embodiments, one or more additional spacer members (e.g., similar to spacer member 216) can be disposed between the first and/or second lubrication members 210, 218 and/or the blade member 214.

Although not shown, in other embodiments, the safety razor 200 can comprise more than two lubrication members. For example, the safety razor 200 can include a third lubrication member. In one particular embodiment, the third lubrication member can, for example, be disposed between the guard member 212 and the blade member 214. The third lubrication member can be spaced relative to the blade member 214 by a spacer member (e.g., similar to spacer member 216).

Additionally or alternatively, the safety razor 200 can include one or more additional lubrication members adjacent to any and/or all of the lubrications members. For example, two additional lubrications can be disposed adjacent the second lubrication member 218 to form a "stack" or "series" of three lubrication members. In some of such embodiments, each lubrication member in the stack can abut an adjacent lubrication member. In other such embodiments, each lubrication member can be spaced relative to an adjacent lubrication member by a spacer member (e.g., similar to spacer member 216).

In some embodiments, the lubrication members can be tapered in the lateral direction relative to each other. In other words, each lubrication member can be at least slightly laterally larger than the lubrication members disposed above it and at least slightly smaller than the lubrication members disposed below it. The angle or amount of taper of the lubrication members can vary. In some embodiments, the angle of taper of the lubrication members can, for example, follow (at least generally) the taper of the other components of the head portion 202. In some embodiments, the angle of taper can be from about 0 degrees to about 60 degrees relative to the longitudinal axis of the handle portion. In particular embodiments, the angle of taper can be from about 20 degrees to about 40 degrees. In one particular embodiment, the angle of taper can be about 30 degrees. Tapering the lubrication members in this manner can, for example, allow each lubrication member to contact the user's skin when the safety razor 200 is angled against the user's skin during shaving.

Figure 11:
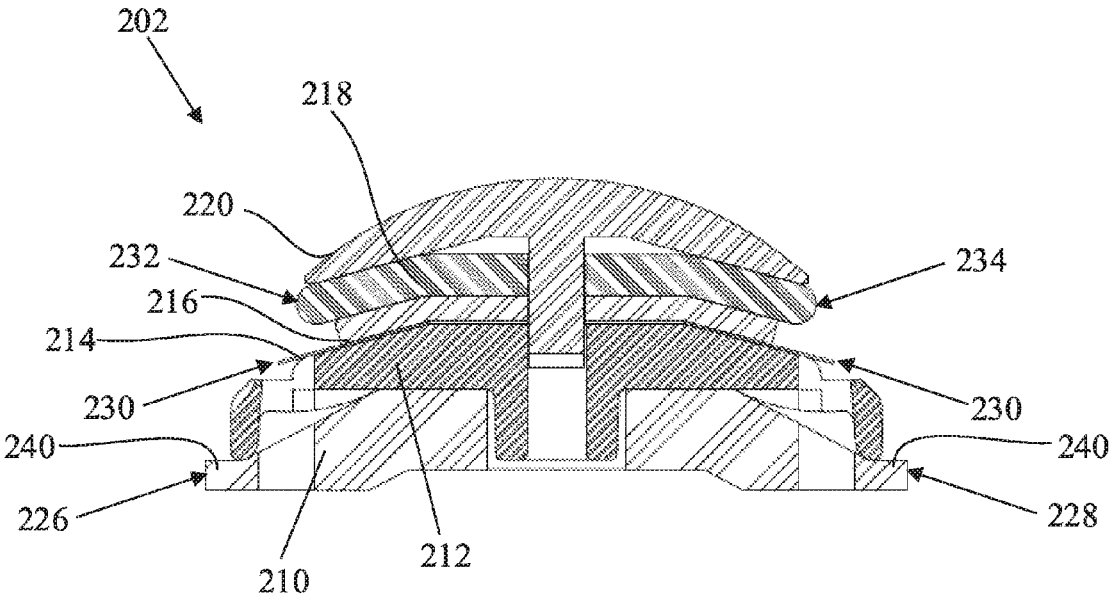
FIG. 11 is a cross-sectional view of the safety razor of FIG. 7, taken along the line 11-11 as shown in FIG. 9.

Referring to FIG. 11, the first lubrication member 210 can have first and second edge portions 226, 228. The first and second edge portions 226, 228 can be parallel, or at least substantially parallel, to cutting edge portions 230 of the blade member 214 such that the first and second edges 226, 228 can contact a user's skin when a cutting edge portion 230 of the blade member contacts the user's skin. The first and second edge portions 226, 228 can comprised various configurations (e.g., flat, rounded, angled, etc.). As shown, in some embodiments, the first and second edge portions 226, 228 can be flat. Although not shown, in other embodiments, the first and second edge portions 226, 228 can be rounded (e.g., in a manner similar to first and second edge portions 232, 234 of the second lubrication member 218), which allows the first and second edge portions 226, 228 to contact the user's skin at various angles.

The second lubrication member 218 can have first and second edge portions 232, 234. The first and second edge portions 232, 234 can be parallel, or at least substantially parallel, to cutting edge portions 230 of the blade member 214 such that the first and second edges 232, 234 can contact a user's skin when a cutting edge portion 230 of the blade member 214 contacts the user's skin. The first and second edge portions 232, 234 can comprised various configurations (e.g., flat, rounded, angled, etc.). As shown, in one particular embodiment, the first and second edge portions 232, 234 can be rounded.

Figure 9:
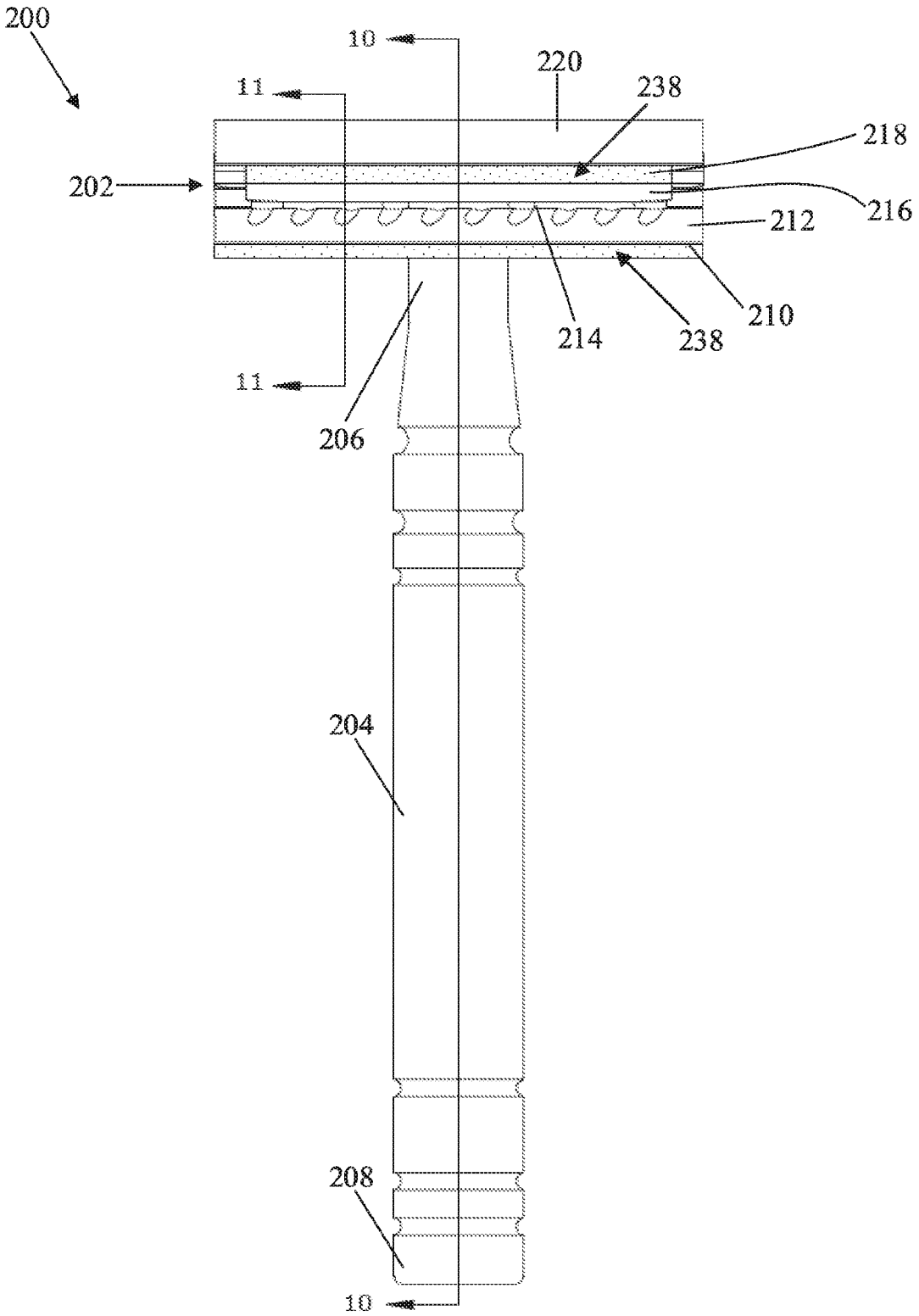
FIG. 9 is a side view of the safety razor of FIG. 7.
Figure 10:
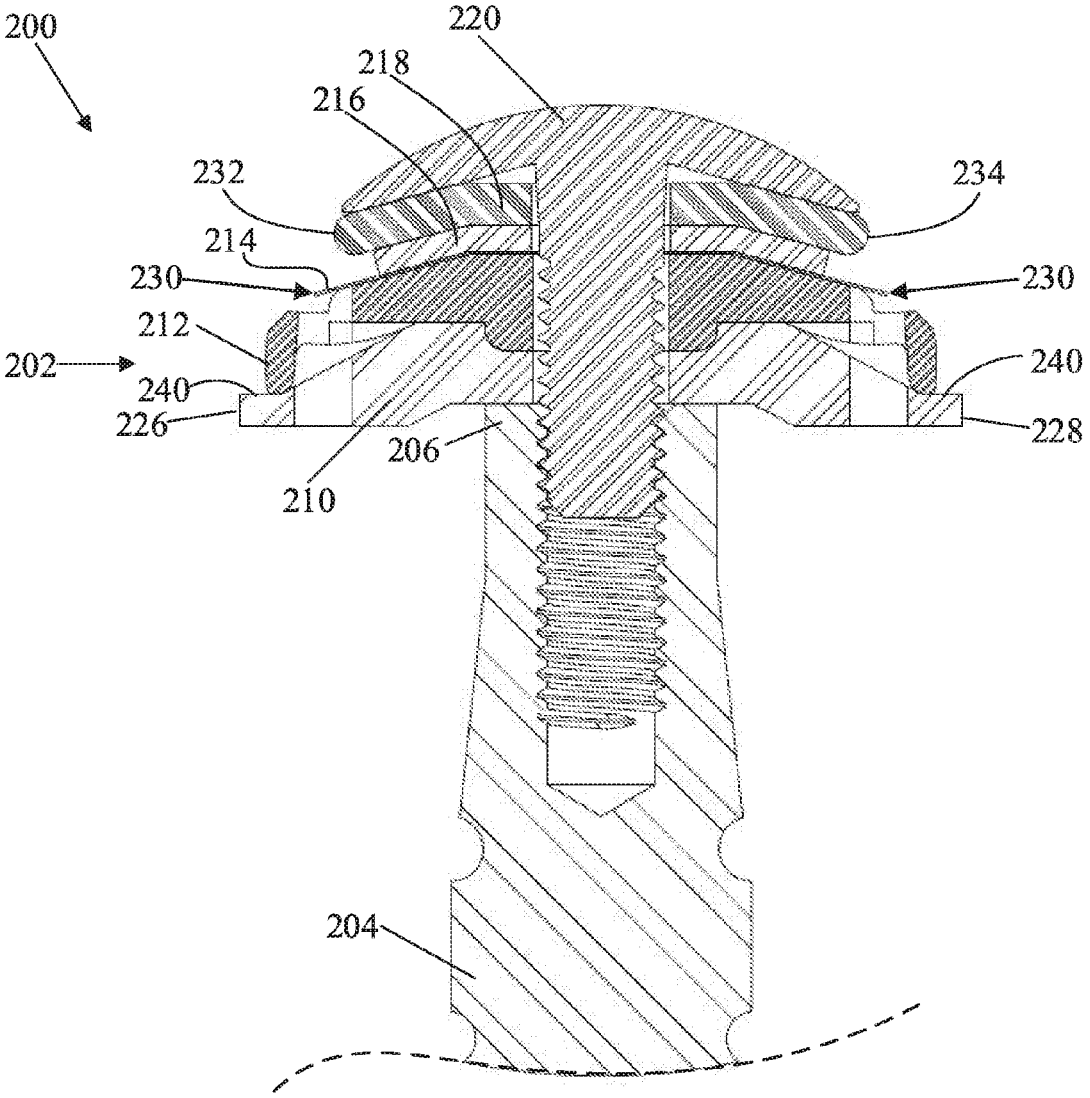
FIG. 10 is a partial cross-sectional view of the safety razor of FIG. 7, taken along the line 10-10 as shown in FIG. 9.

The first and second lubrication members 210, 218 can be formed of various materials, including polymers, metals, etc. The first and second lubrication members 210, 218 can comprise a lubricating substance 238 which can, for example, be attached and/or applied to the first and second edge portions 226, 228, 232, 234 of the first and second lubrication members 210, 218, as best shown in FIGS. 7, 9, and 12. For example, in some embodiments, the lubricating substance 138 can be a coating that is applied to the surface of the lubrication member 116. In other embodiments, the lubricating substance 138 can be applied to a lubrication strip that is attached to the lubrication member 116 (e.g., with an adhesive). In yet other embodiments, the lubricating substance 138 can be applied to an insert that clips, snaps, slides, and/or is otherwise removably coupled to the lubrication member 116.

The lubricating substance can also be attached or applied to various other portions of the first and second lubrication members 210, 218. For example, as shown in FIG. 7, the lubricating substance 238 can be attached and/or applied to an upwardly facing surface 240 of the first lubrication member 210.

The lubricating substance 238 can be formed from various materials, such as polyethylene oxide. The lubricating substance 238 can be configured to lubricate the user's skin as the user moves the safety razor 100 along the user's skin, thereby reducing the resistance (e.g., drag) of the safety razor 200 on the user's skin. This in turn can advantageously reduce skin irritation caused by the cutting edge portion 136 of the blade member pressing against and moving along the user's skin.

The components of the head portion 202 can include mating features configured to align and to prevent relative movement of the components when the head portion 202 is coupled to the handle portion 202, for example, in a manner similar to the safety razor 100. The head portion 202 and the handle portion 204 can be removably coupled together, for example, in a manner similar to the safety razor 100.

Figure 13:
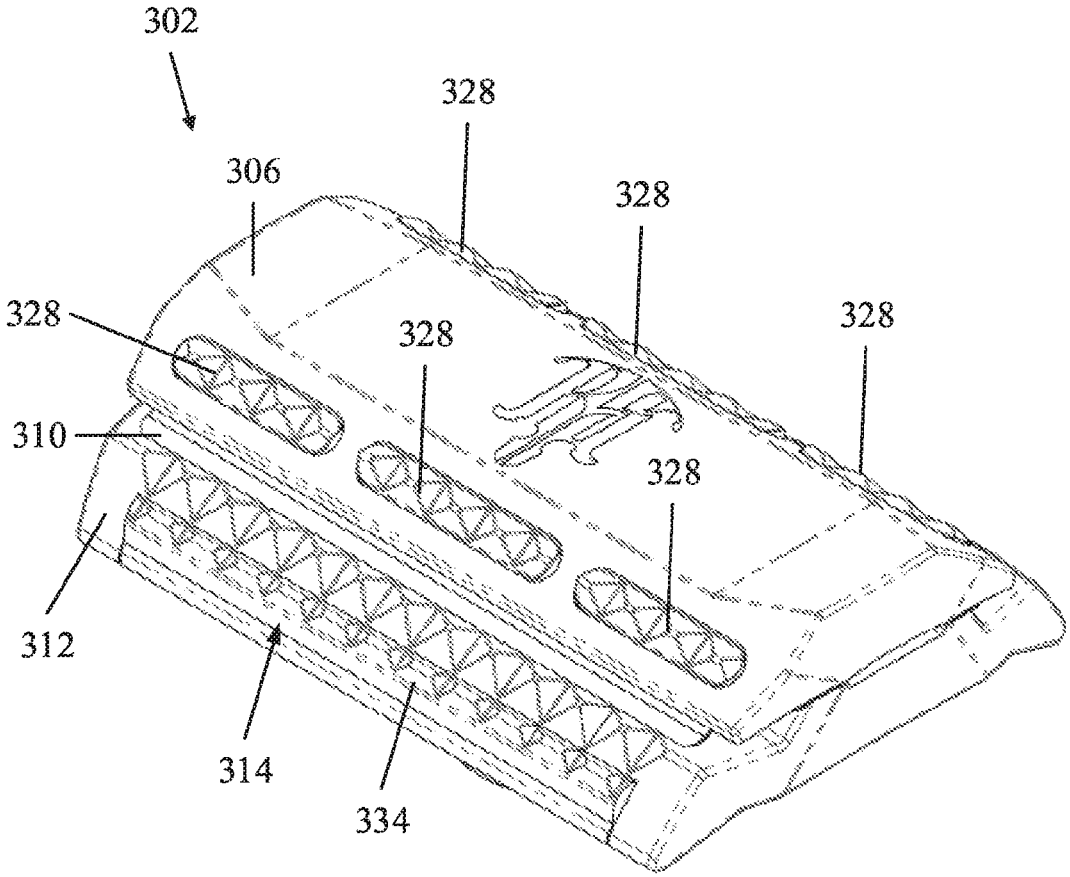
FIG. 13 is a perspective view of another exemplary embodiment of a safety razor, shown without a handle portion.
Figure 14:
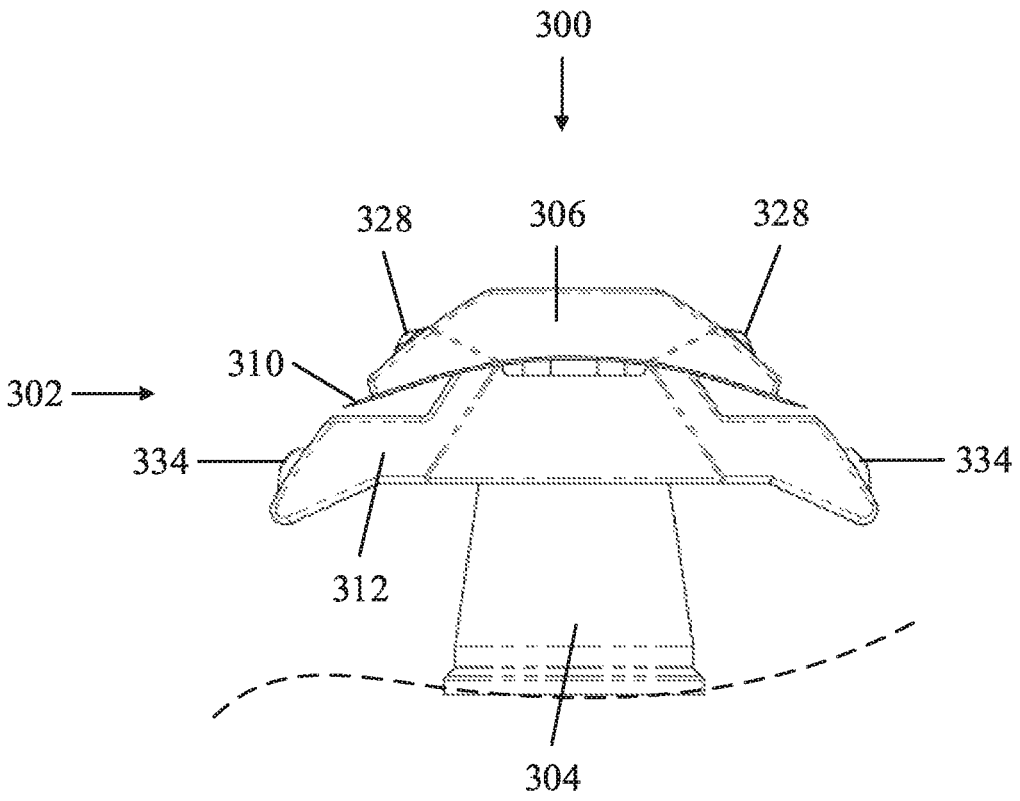
FIG. 14 is an end view of the safety razor of FIG. 13, with the handle portion partially shown.
Figure 15:
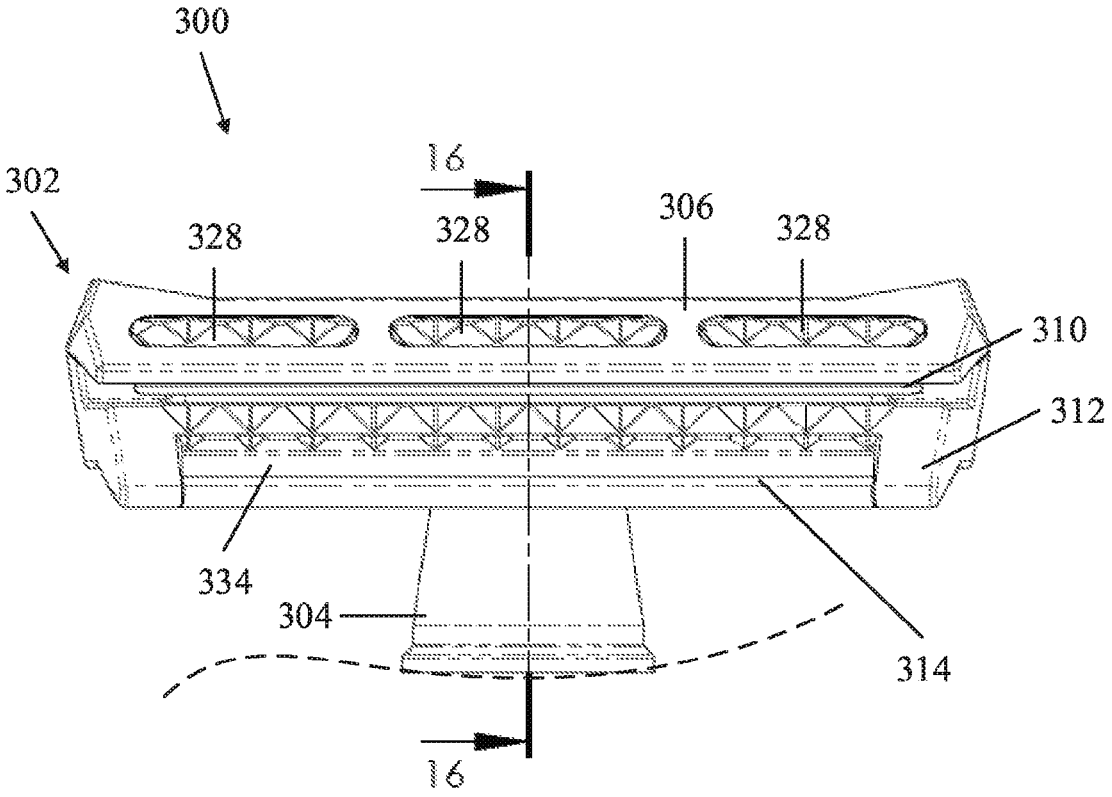
FIG. 15 is a side view of the safety razor of FIG. 13, with the handle portion partially shown.
Figure 16:
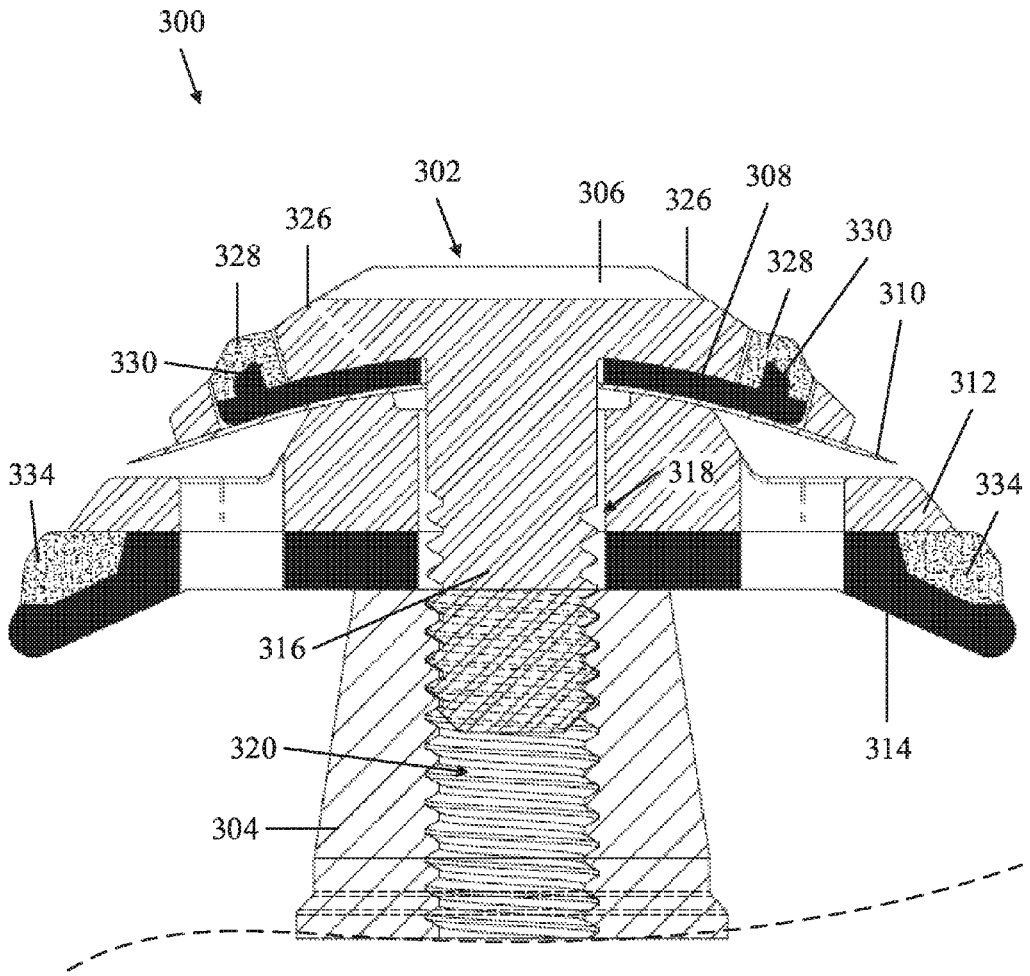
FIG. 16 is a cross-sectional view of the safety razor of FIG. 13, taken along the line 16-16 as shown in FIG. 15 and with the handle portion partially shown.
Figure 17:
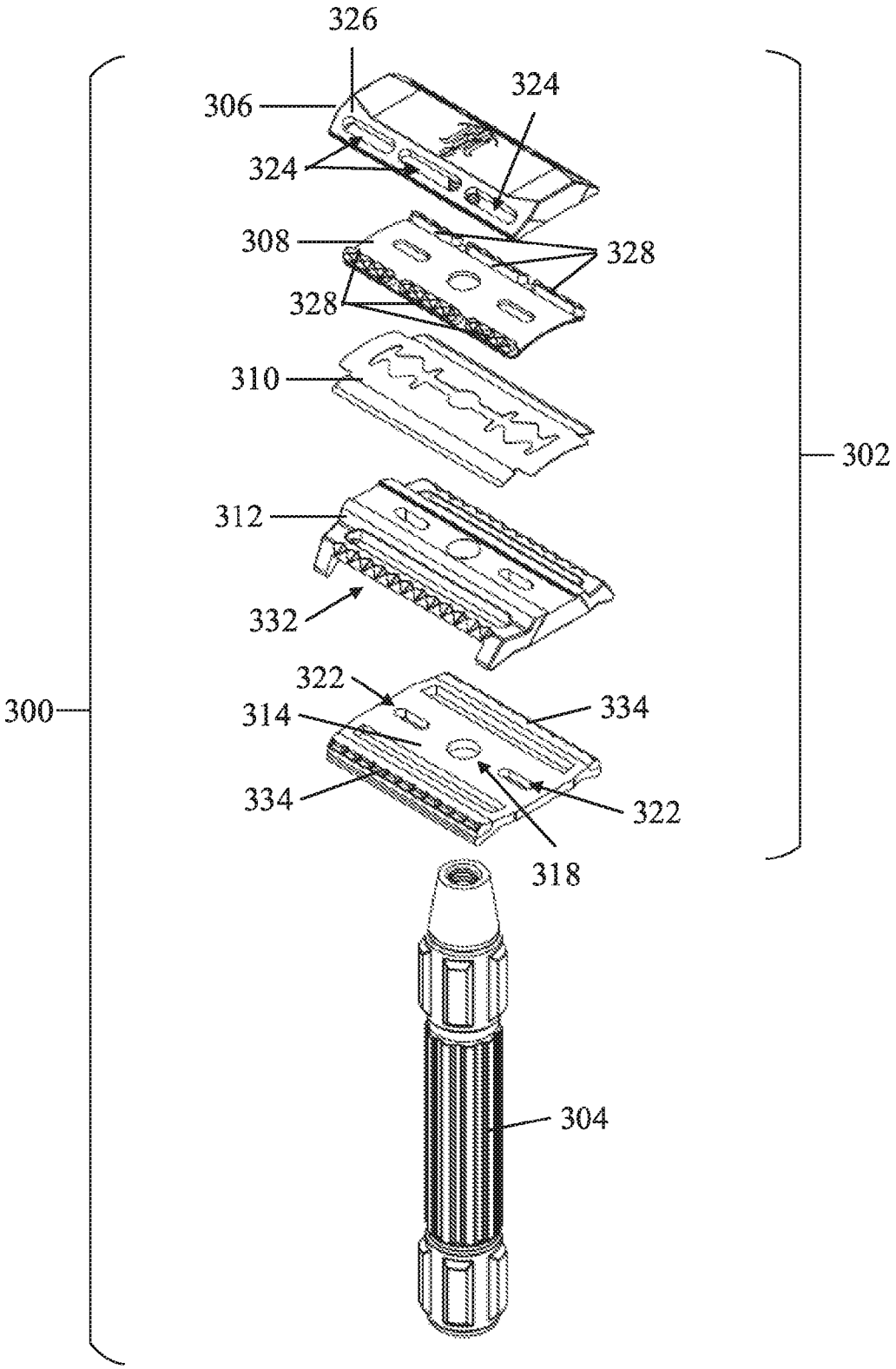
FIG. 17 is an exploded view of the safety razor of FIG. 13, shown with the handle portion.

FIGS. 13-17 show a DE safety razor 300, according to another exemplary embodiment. Referring to FIG. 14, the safety razor 300 can comprise two main components: a head portion 302 and a handle 304 (only partially shown). As shown in FIGS. 16-17, the head portion 302 can be removably coupled to the handle 304 in a manner similar to the manner in which the head portion 102 is removably coupled to the handle 104 (e.g., threadably), as further described above.

Referring to FIG. 17, the head portion 302 of the safety razor 300 can comprise a cap 306, a first lubrication member 308, a blade 310, a guard 312, and a second lubrication member 314 (collectively referred to as "the components of the head portion 302"). The components of the head portion 302 can be arranged in various ways. For example, referring to FIG. 16, the second lubrication member 314 can be disposed on the bottom of the head portion 302 adjacent the handle 304. Moving from the second lubrication member 314 toward the top of the head portion 302 (i.e., upward as illustrated in FIG. 17), the guard 312 can be disposed above the second lubrication member 314. The blade 310 can be disposed above the guard 312. The first lubrication member 308 can be disposed above the blade 310. The cap 306 can be disposed above the first lubrication member 308 at the top of the head portion 302.

Referring still to FIG. 16, the cap 306 includes a projection 316 and a plurality of tabs extending from a bottom surface of the cap 306. The projection 316 can extend through openings 318 of the other components of the head portion 302 and into a bore 320 of the handle portion 304 to removably (e.g., threadably) couple the head portion 302 and the handle portion 304. The tabs can be configured to extend through openings 322 (FIG. 17) of the other components of the head portion 302 (e.g., similar to the tab 140 of the safety razor 100). For purposes of clarity, the opening 318, 322 are labeled in FIG. 17 only on the second lubrication member 314.

As shown in FIG. 17, the cap 306 can also include a plurality of openings 324 extending therethrough. For example, in the illustrated embodiment, the cap 306 has six openings 324 (i.e., three on each side of the cap 306) extending through side surfaces 326 of the cap 306. In other embodiments, the cap 306 can have more or less than six openings 324 (e.g., 1-20), and/or the openings 324 can be disposed in various other locations on the cap 306. The openings 324 can be configured for receiving lubrication strips.

Referring still to FIG. 17, the first lubrication member 308 can have one or more lubrication strips 328 coupled thereto. For example, in the illustrated embodiment, the first lubrication member 308 has six lubrication strips 324 (i.e., three on each side of the first lubrication member 308) extending from the upper surface of the first lubrication member 308. In other embodiments, the first lubrication member 308 can have more or less than six lubrication strips 328 (e.g., 1-20), and/or the lubrication strips 328 can be disposed in various other locations on the first lubrication member 308.

The lubrication strips 328 can be coupled to the first lubrication member 308 in various ways such as with adhesive, fasteners, and/or molding or injecting the strips on the first lubrication member 308. In some embodiments, the lubrication strips 328 can include a lubricating substance or coating that is applied and/or formed on the first lubrication member 308.

As shown in FIG. 16, the first lubrication member 308 can, in certain embodiments, have ridges 330 extending from the upper surface of the first lubrication member 308. The lubrication strips 328 can be disposed on and/or surround the ridges 330. The ridges 330 can, for example, provide support for the lubrication strips 328 and strengthen the connection between the lubrication strips 328 and the lubrication member 308.

As also shown in FIG. 16, the lubrication member 308 can be configured to nest under the cap member 308 such that at least a portion of the cap 306 directly contacts the blade 310. The lubrication strips 328 can be configured to align with and extend through the openings 324 of the cap 306. In this manner, the lubrication strips 328 can contact and lubricate a user's skin as the user slides the head portion 302 of the safety razor along their skin.

The blade 310 can be configured similar to the blade 112 of the safety razor 100.

Referring again to FIG. 17, the guard 312 can generally be configured similar to the guard member 110 of the safety razor 110, except the guard 312 has notches 332 formed on the sides of the guard 312. The notches 332 can, for example, be configured to receive lubrication strips or skin tensioning members, as further described below.

The second lubrication member 314 can comprise lubrication strips 334. For example, in the illustrated embodiment, the lubrication member 314 has two lubrication strips 334 (i.e., one on each side of the second lubrication member 314) extending therefrom. The lubrication strips 334 can be disposed in the notches 332 of the guard 312.

In some embodiments, the guard 312 can extend laterally beyond lubrication strips 334 adjacent the notches 332 of the guard 312, as shown in FIG. 13. In this manner, the guard 312 can, for example, provide support to the lubrication strips 334.

The lubrication strips 334 can contact and lubricate a user's skin as the user slides the head portion 302 of the safety razor along their skin.

In other embodiments, the second lubrication member 314 can have more or less than two lubrication strips 334 (e.g., 1-20). In some such embodiments, the guard 312 can have one or more openings (e.g., similar to the openings 324 of the cap 306) rather than the notches 332. The second lubrication member 314 can extend through the openings of the guard 312 similar to the manner in which the lubrication strips 328 extend through the openings 324 from the cap 306.

The lubrication strips 334 can be coupled to the second lubrication member 314 in various ways such as with adhesive, fasteners, and/or molding or injecting the strips on the second lubrication member 314. In certain embodiments, the second lubrication member 314 can include ridges (e.g., similar to the ridges 330 of the first lubrication member).

In some embodiments, the lubrication strips 334 can include a lubricating substance or coating that is applied and/or formed on the second lubrication member 314.

In lieu of the second lubrication member 314, the safety razor 300 can include a skin tensioning member. The skin tensioning member can be configured to stretch the user's skin and prepare the hair to be cut as the user slides the head portion 302 of the safety razor along their skin. In certain embodiments, the skin tensioning member can be comprise a polymer and/or a polymeric coating. In some embodiments, the skin tensioning member can, for example, include ribs, nubs, and/or other projections.

A user can use the safety razor 300 with or without the first lubrication member 308 and/or the second lubrication member 314 or the skin tensioning member installed on the head portion 302 of the safety razor 300. One particular advantage of the safety razor 300, for example, is that the portion of the blade 310 that is exposed beyond the cap 306 and/or the guard 312 is the same with or without first lubrication member 308 and/or the second lubrication member 314 or the skin tensioning member installed on the head portion 302 of the safety razor 300. This is illustrated in FIGS. 14 and 16.

When using the safety razor 300 without the first lubrication member 308, the openings 324 in the cap 306 can, for example, provide additional channels through which fluid (e.g., water) can flow to improve rinsing and cleaning of head portion 302. This can, for example, also reduce or prevent cut hair from clogging the blade 310.

In some embodiments, various components of the safety razors 100, 200, 300 (e.g., lubrications members 116, 210, 218, 308, 314, spacers 114, 216, caps 118, 220, 306, etc.) can be a separate lubrication device and/or system that can be configured to be used with various other safety razors. For example, the lubrication member 116, the spacer 114, and the cap 118 can be a lubrication system configured to be removably coupled to a safety razor that does not have a lubrication system and/or that has an additional or alternative lubrication system. In another example, the cap 306 and the first lubrication member 308 can be a lubrication system configured to be coupled to a safety razor that does not have a lubrication system and/or that has an additional or alternative lubrication system. This advantageously allows a user to selectively interchange and/or exchange each component as desired.

Configuring a safety razor (e.g., safety razors 100, 200, 300) and/or a lubrication system as described herein can advantageously allow a user to independently remove and/or replace each component of the head portion (e.g., the head portion 102) and/or the handle portion (e.g., the handle portion 104) of the safety razor as desired. For example, a user can exchange a dull blade member for a new blade member and can continue to use the lubrication member if there is an unused portion of the lubricating substance on the lubrication member. As another example, a user can exchange the lubrication member for a new lubrication member and can continue to use the blade member if the blade member is still sufficiently sharp. The safety razors and lubrication systems described herein are therefore relatively more economical and less wasteful than typical cartridge razors which require a user to exchange the entire head portion when only a single component (e.g., the blade member) needs to be replaced.

In addition, the safety razors and lubrication systems described herein can also significantly improve typical safety razors by providing lubrication members and lubricating substances for a safety razor which can, for example, advantageously improve the closeness and/or comfort of a shave compared to typical safety razors.

In view of the many possible embodiments to which the principles of the present disclosure may be applied, it should be recognized that the illustrated embodiments are only preferred examples and should not be taken as limiting the scope of the disclosure. Rather, the scope of the present disclosure is defined by the following claims. I therefore claim all that comes within the scope and spirit of these claims.

The invention claimed is:

1. A safety razor, comprising:

a handle having a first end portion with a handle aperture and a second end portion; and a head portion removably coupled to the first end portion of the handle and having:

a guard;

a replaceable blade having at least one cutting edge;

a replaceable lubrication member comprising one or more lubrication strips; and a cap having one or more openings formed therein and a projection extending therefrom, wherein the projection is configured to extend through respective apertures in the lubrication member, the blade, the guard, and into the handle aperture to removably couple the head portion to the handle, wherein the one or more lubrication strips of the lubrication member extend through the one or more openings of the cap.

2. The safety razor of claim 1, wherein the lubrication member is a first lubrication member, and the lubrication strips are first lubrication strips, and wherein the head portion further includes a second lubrication member disposed between the guard and the handle and having one or more second lubrication strips.

3. The safety razor of claim 1, wherein the head portion further includes a skin tensioning member having an aperture to receive the projection of the cap and the skin tensioning member is disposed between the guard and the first end portion of the handle.

4. The safety razor of claim 1, wherein the blade and the lubrication member are independently removable and replaceable relative to each other and the head portion when the head portion is removed from the handle.

5. The safety razor of claim 1, wherein the lubrication member is configured to nest under the cap such that at least a portion of the cap directly contacts the blade.

6. The safety razor of claim 1, wherein the lubrication member comprises a first side portion and a second side portion, and the one or more lubrication strips includes at least one lubrication strip disposed on the first side portion of the lubrication member and at least one other lubrication strip disposed on the second side portion of the lubrication member.

7. The safety razor of claim 6, wherein the one or more openings of the cap includes at least one opening formed in a first side portion of the cap and configured for receiving the at least one lubrication strip disposed on the first side portion of the lubrication member and at least one other opening formed in a second side portion of the cap and configured for receiving the at least one other lubrication strip disposed on the second side portion of the lubrication member.

8. The safety razor of claim 1, the at least one cutting edge is a first cutting edge and a second cutting edge, wherein the first cutting edge is disposed on a first side of the blade and the second cutting edge is disposed on a second side of the blade.

* * * * *